US005531486A

United States Patent [19]

Parker

[11] Patent Number: 5,531,486

[45] Date of Patent: Jul. 2, 1996

[54] MOUNTING MEANS FOR A DOOR OF SHEET MATERIAL

[75] Inventor: Andrew J. Parker, Chapel Hill, N.C.

[73] Assignee: Regent Lighting Corporation, Burlington, N.C.

[21] Appl. No.: 402,630

[22] Filed: Mar. 13, 1995

[51] Int. Cl.[6] ..... E05C 5/00

[52] U.S. Cl. ..... 292/63; 292/68; 49/463; 16/268

[58] Field of Search ..... 292/63, 68, 8, 292/11, 24, 32, 56, 109, 114, 213, 5, DIG. 17, 67; 49/389, 463; 16/260, 262, 266, 268

[56] References Cited

U.S. PATENT DOCUMENTS

| | | | |
|---|---|---|---|
| 932,601 | 8/1909 | Corbett | 16/268 |
| 1,441,599 | 1/1923 | Platt | 16/268 |
| 2,332,017 | 10/1943 | Sedgwick | 16/268 |
| 2,440,186 | 4/1948 | Runge | 16/268 |
| 2,912,568 | 11/1959 | Winkler | 16/268 |
| 3,411,242 | 11/1968 | Robinson, Jr. | 49/463 |
| 4,041,571 | 8/1977 | Blevins | 16/268 |

*Primary Examiner*—Rodney M. Lindsey

[57] ABSTRACT

This device includes: (a) an access opening, (b) support structure located adjacent an edge of the access opening and containing a plurality of slots, and (c) a sheet-metal door having one edge located adjacent the support structure, having a closed position covering the access opening, and having a fully-open position in which the door is perpendicular to its position when closed. The door is swingable between its closed and fully-open positions about a pivot axis located near said one door edge. The door includes a plurality of tabs projecting outwardly from said one edge, each tab being of a generally L-shaped cross-section when viewed from a reference plane perpendicular to the pivot axis. Each tab comprises a first arm located in the major plane of the door and a second arm extending transversely of the first arm. The second arm fits in an associated one of the slots and includes an extension extending laterally of the second arm beyond one end of the slot into a region behind the support structure when the door is in its closed position. When in its fully-open position, the door is laterally movable while the second arm is in its associated slot to a sufficient extent to shift the extension into a position of alignment with the slot, thereby allowing the door to be removed from the support structure.

6 Claims, 3 Drawing Sheets

MOUNTING MEANS FOR A DOOR OF SHEET MATERIAL

TECHNICAL FIELD

This invention relates to mounting means for a door of sheet material and, more particularly, relates to mounting means for the swingable sheet-metal door of a lighting fixture.

BACKGROUND

Certain devices include an access opening and a door of sheet material that can be swung between a closed position covering the access opening and a fully-open position approximately perpendicular to the position of the door when closed. In certain of these devices, it is desirable that the door be retained and latched in its fully-open position or, if desired, be completely removable from its support structure. Certain hinges combined with latch structures allow the door to be operated in this manner. Such combinations are typically relatively expensive and rather involved to manufacture and install.

OBJECT

An object of my invention is to provide, for mounting a swingable door, simple and inexpensive mounting means that supports the door when it is swung between its closed and fully-open positions and, which also can act to latch the door in its fully-open position or, if desired, can allow the door to be easily removed from its support structure.

SUMMARY

In carrying out the invention in one form, I provide a device that includes an access opening and comprises support structure fixed relative to the access opening, located adjacent an edge of the access opening, and containing a plurality of slots. A sheet-metal door has one edge located adjacent the support structure, a closed position in which the door covers the access opening, and a fully-open position in which the door is generally perpendicular to the closed position, the door being swingable between its closed and fully-open positions about a pivot axis near said one door edge.

The door includes a plurality of tabs projecting outwardly from said door edge, each tab being of a generally L-shaped cross-section when viewed from a reference plane perpendicular to the pivot axis. Each tab comprises a first arm generally located in the major plane of the door and a second arm extending transversely of the first arm and fitting in one of the slots in the support structure. The second arm includes an extension that extends laterally beyond one end of its slot into a region behind the support structure when the door is in its closed position. The door, when in its fully-open position, is laterally movable while the second arm is in its slot to a sufficient extent to shift said extension into a position of alignment with the slot, thereby allowing the second arm of the tab to be withdrawn from the support structure through the slot, thus allowing the door to be removed from the support structure.

The door, when fully open, can be pushed inwardly of the support structure, thereby pushing the first arm of the tab through its slot in a direction inwardly of the support structure. The support structure includes a latching portion immediately adjacent the first arm when the first arm is pushed through the slot. After the first arm has been pushed through the slot, this latching portion bears against the first arm when the door is urged toward its closed position, thereby holding the door in its fully-open position.

BRIEF DESCRIPTION OF THE FIGURES

For a better understanding of the invention, reference may be had to the following detailed description of an embodiment of the invention and to the accompanying drawings, wherein.

DETAILED DESCRIPTION OF AN EMBODIMENT

Figure 1:
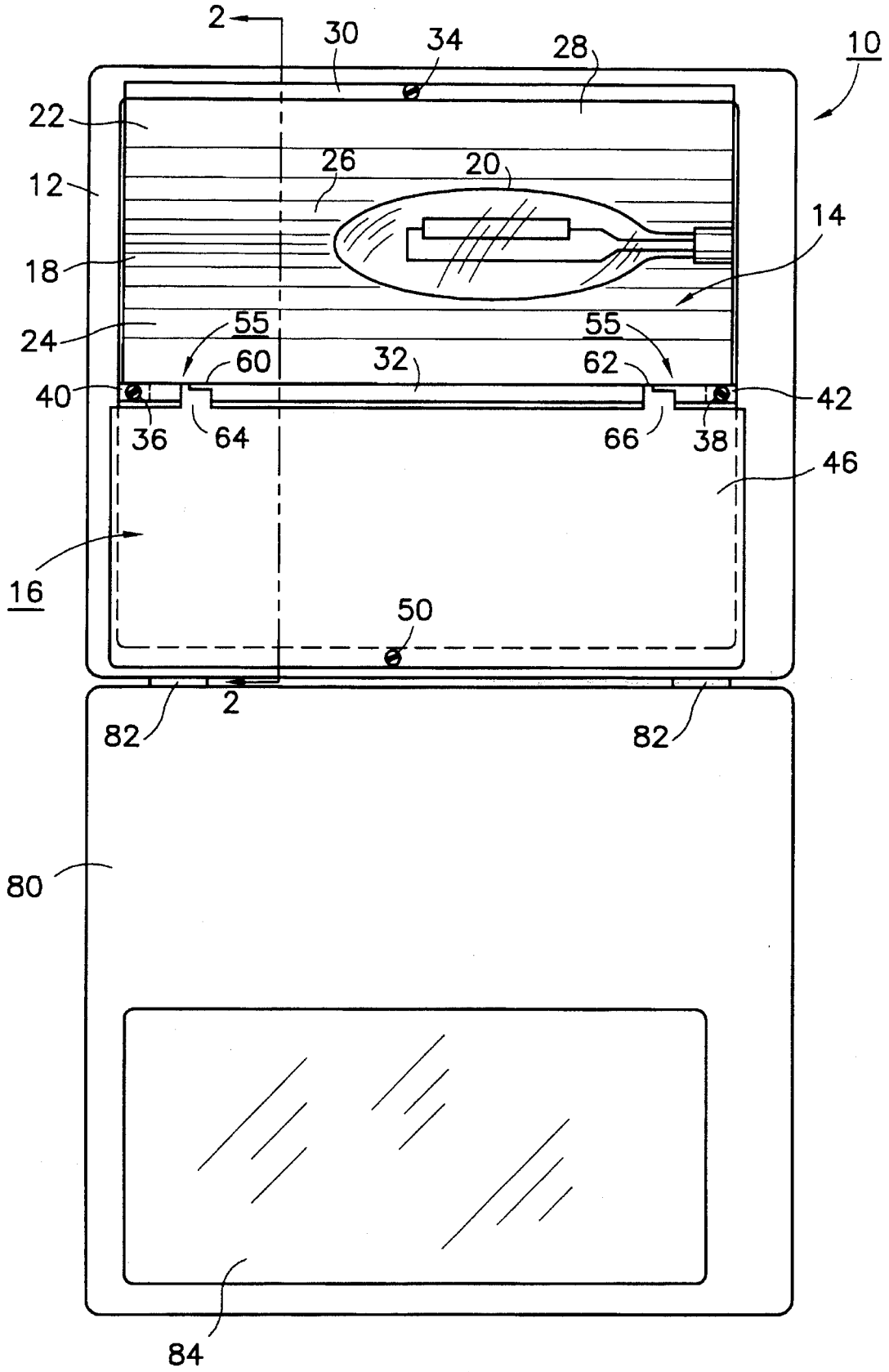
FIG. 1 is a front elevational view of a lighting fixture comprising a lamp compartment, a ballast compartment, and a sheet-metal door 46 covering an access opening to the ballast compartment.
Figure 2:
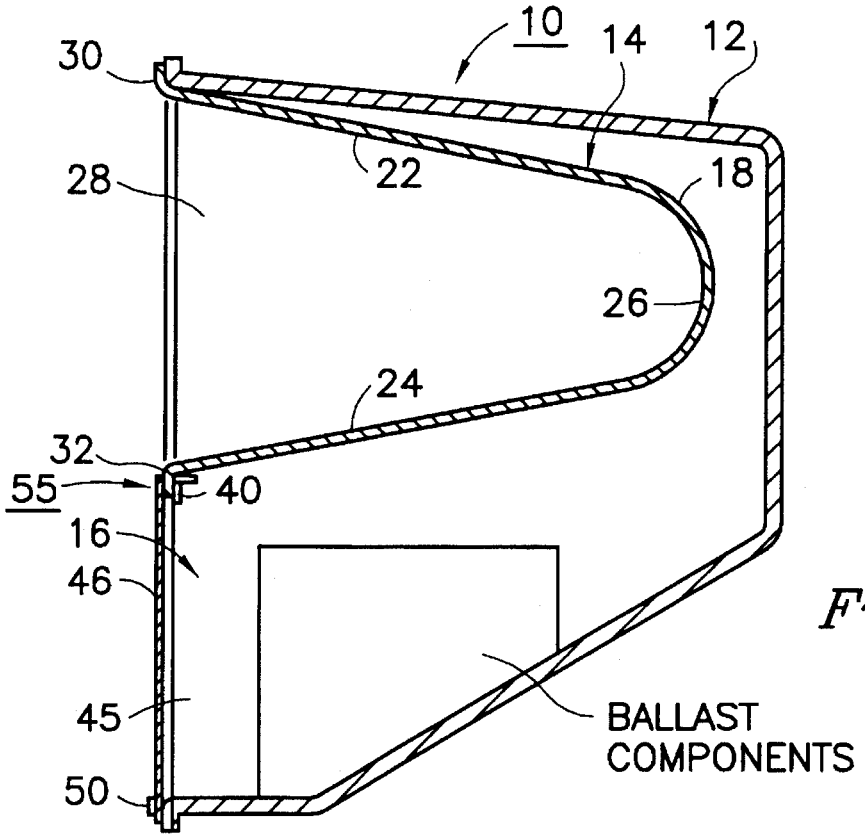
FIG. 2 is a sectional view along the line 2—2 of FIG. 1.

Referring now to FIGS. 1 and 2, the lighting fixture 10 shown therein comprises a metal housing 12 including a lamp compartment 14 and a ballast compartment 16. In the lamp compartment there is a trough-shaped sheet-metal reflector 18 and a conventional lamp 20 mounted within the reflector 18. The reflector comprises a main body portion comprising a pair of spaced-apart arms 22 and 24 joined together at one end by a junction portion 26 and defining at their opposite ends a front opening 28 through which light developed by the lamp is reflected into the region at the front of the fixture.

The reflector 18 is mounted within the housing 12 by means of flanges 30 and 32 at the front end of the arms 22 and 24. These flanges are suitably fastened to the housing 12, as by screws 34, 36, and 38. Screw 34 extends through a hole in the upper flange and is threaded into a registering hole in the housing 12. Screws 36 and 38 extend through holes in the lower flange and are respectively threaded into registering holes in lugs 40 and 42 projecting from the sidewalls of the housing 12.

The ballast compartment 16 has an access opening 45 at its front face that is normally closed off by a sheet-metal door 46. Within the ballast compartment 16 are conventional ballast components (shown in block form in FIG. 2) that are used for controlling the electric power supplied to the lamp 20. When it is desired to gain access to the ballast components in order to inspect, maintain, or replace them, the door 46 is opened. This is accomplished by first removing a screw 50 at the bottom edge of the door, which screw extends through a hole at the bottom edge of the door and into a registering internally-threaded opening in the housing 12.

Figure 6:
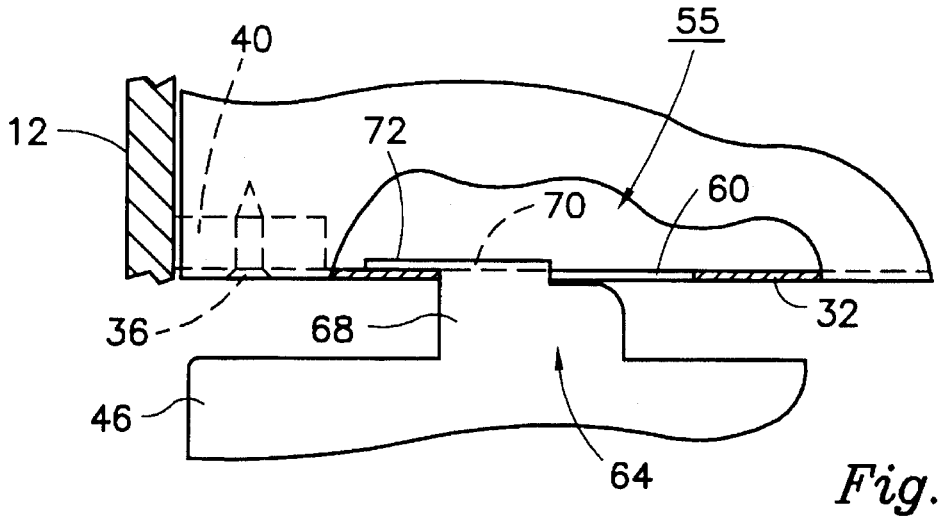
FIG. 6 is a plan view of the mounting means of FIGS. 3–5, with the door shown in its fully-open position.

The door is then swung about a horizontal pivot axis near its top edge into a fully-open position, depicted in FIG. 6, that is substantially perpendicular to its normal, or closed, position shown in FIG. 2. When this has been done, the door can either be latched in this fully-open position or completely removed.

Mounting means 55 at the top edge of the door 46 enables the door to be operated in this manner. This mounting means comprises two spaced-apart identical slots 60 and 62 in the reflector and two integral tabs 64 and 66 of identical form at the top edge of the door. The slots 60 and 62 are located in the front region of the reflector where its flange 32 joins the reflector arm 24. Each of the tabs 64, 66 is of an L-shaped cross-section when viewed in a cross-sectional view such as shown in FIG. 4. Each L-shaped tab comprises two arms 68 and 70. The first arm 68 is generally located in the major plane of the door 46, and the second arm 70 extends transversely of the first arm. When the door is in its closed position of FIGS. 3 and 4, the second arm 70 fits into an associated slot 60 or 62 in the reflector. Referring to FIG. 5, the second arm 70 has an extension 72 that extends laterally of the second arm beyond one end of the slot 60 into a region behind the flange 32 of the reflector. When the door is swung open, its parts enter the position shown in FIG. 6. The first arm 68 of the tab 64 is then positioned in the slot 60.

During the above-described swinging motion of the door, the lower edge of the slot 60 acts as a bearing surface on which the associated tab can pivot when the door is swung from its closed position to its fully-open position.

Figure 7:
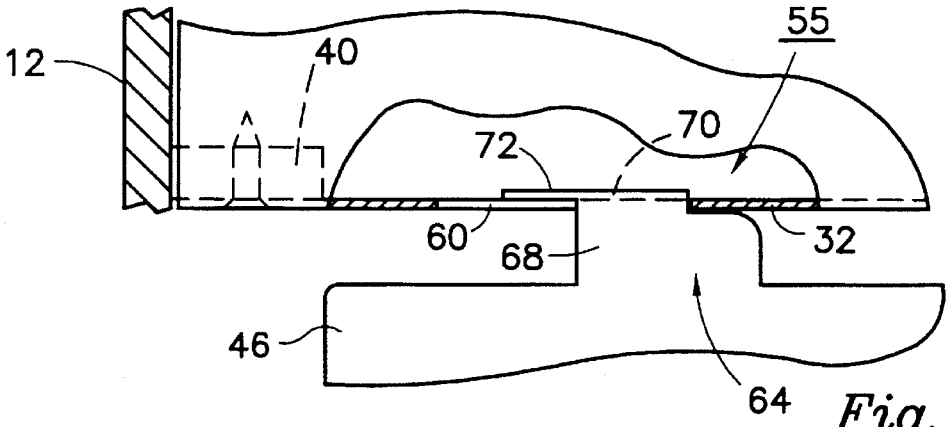
FIG. 7 is a plan view similar to that of FIG. 6 except showing the parts after the door has been shifted to the right from its position of FIG. 6.

When the door is in its fully open position of FIG. 6, it can either be removed or latched in the fully-open position, at the option of the user. To remove the door, the user slides the door to the right from its position of FIG. 6 to its position of FIG. 7. This motion of the door shifts the entire second arm 70, 72 into a position of alignment with its slot 60, as shown in FIG. 7. A corresponding action takes place at the second slot 62. The user may then lift the door out of its supporting structure 32, carrying the arm 70 and its extension 72 freely through the slot 60, and simultaneously effecting a corresponding action at slot 62.

Figure 8:
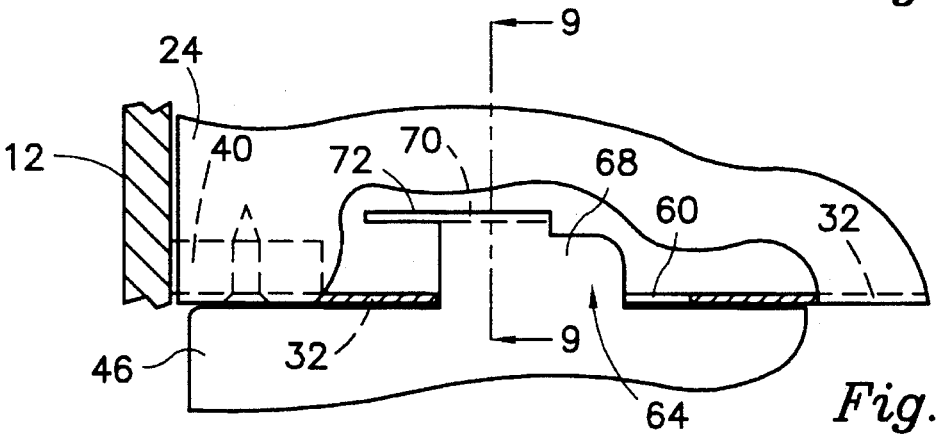
FIG. 8 is a plan view of the mounting means depicted in FIG. 7 after the door 46 has been pushed inwardly to latch it in its fully-open position.
Figure 9:
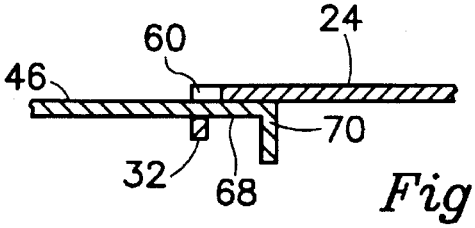
FIG. 9 is a sectional view taken along the line 9—9 of FIG. 8.

If, instead of removing the door, the user desires to latch the door in its fully-open position after it has entered into its position of FIG. 6, the user pushes the door inwardly from its position of FIG. 6 into its position of FIGS. 8 and 9. In the position of FIGS. 8 and 9, the weight of the door forces the upper surface of the arm 68 of the tab to bear against the lower outside surface of the reflector component 24, and forces the lower surface of arm 68 to bear against the bottom edge of slot 60, as shown in FIG. 9. This results in the door being effectively latched in the fully-open position of FIGS. 8 and 9. It is to be understood that a corresponding latching action takes place at the other slot 62 when the door is pushed inwardly into its position of FIGS. 8 and 9.

To restore the door to its closed position from its position of FIGS. 8 and 9, the above-described steps are performed in reverse order. That is, the door 46 is pulled outwardly from its position of FIGS. 8 and 9 into its position of FIG. 6, after which it is swung downwardly from its position of FIG. 6 into its position of FIGS. 3–5.

Figure 3:
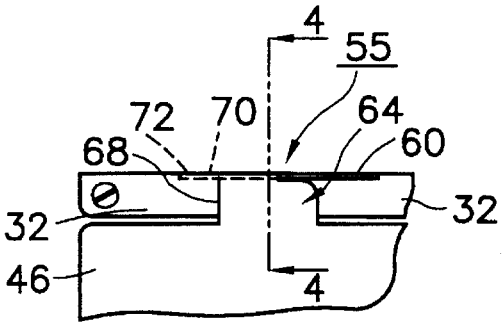
FIG. 3 is an enlarged view of a portion of the mounting means for the sheet-metal door illustrated in FIGS. 1 and 2.
Figure 4:
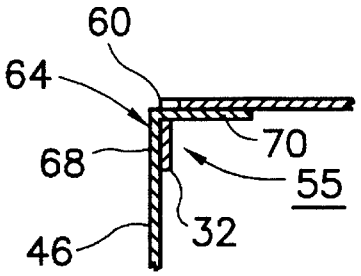
FIG. 4 is a sectional view along the line 4—4 of FIG. 3.
Figure 5:
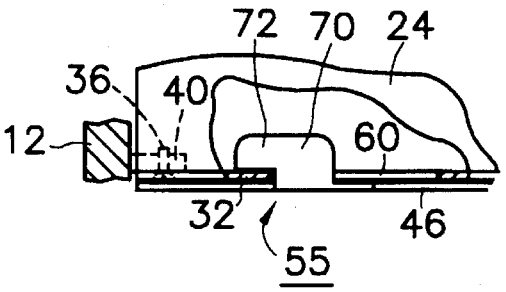
FIG. 5 is a plan view of the mounting means of FIGS. 3 and 4, with the door shown in its closed position.

If the door 46 had been completely removed, it can be reassembled by returning it to its position of FIG. 7, shifted to the left to its position of FIG. 6, and then swung downwardly into its position of FIGS. 3–5.

It will be apparent that the mounting means for the door 46 is a very simple structure that can be easily and economically fabricated during manufacture of the reflector 18 and the door 46. In this respect, the slots 60 and 62 can be introduced at the same time the reflector blank is stamped out, and the tabs 64 and 66 can be produced by the same stamping operation as used for stamping out the remainder of the sheet-metal door 46. The arm 70 on each tab is produced simply by bending the outer end of the tab into a position perpendicular to the inner arm 68.

In FIG. 1, a conventional cover for the whole front of the lighting fixture is shown at 80. This cover, which is pivotally mounted on suitable hinges 82 at the bottom edge of the housing 12, is shown in FIG. 1 in a fully-open position. When the fixture is to be used in its normal manner, the cover 80 is swung upwardly into a position where it covers the front face of the metal housing 12 and is latched in this position by suitable latching means (not shown). A transparent window 84 in the cover 80 allows light to pass therethrough from the lamp compartment 14 when the cover is closed.

While I have shown and described a particular embodiment of the invention, it will be apparent to those skilled in the art that various changes and modifications may be made without departing from the invention in its broader aspects; and I, therefore, intend in the appended claims to cover all such changes and modifications as fall within the true spirit and scope of the invention.

What I claim is:

1. A device that includes an access opening and comprises:

(a) support structure fixed relative to said access opening, located adjacent an edge of the access opening, and containing a plurality of slots, (b) a sheet metal door having one edge located adjacent said support structure, having a closed position in which the door covers said access opening, and having a fully-open position in which the door is generally perpendicular to the position of the door when closed, the door being swingable between its closed and fully-open positions about a pivot axis located near said one door edge, and in which:

(c) said door includes a plurality of tabs projecting outwardly from said door edge, each of said tabs being of a generally L-shaped cross-section when viewed from a reference plane perpendicular to said pivot axis, (d) each L-shaped tab comprises a first arm generally located in the major plane of said door, a second arm extending transversely of said first arm, the second arm of each tab fitting in an associated one of the slots in said support structure and including an extension that extends laterally of said second arm beyond one end of the associated slot into a region behind said support structure when said door is in its closed position, (d) the door, when in its fully-open position, is laterally movable while said second arm is in its associated slot to a sufficient extent to shift said extension into a position of alignment with said slot, thereby allowing the second arm of the associated tab to be withdrawn from said support structure through said slot, thus allowing the door to be removed from said support structure, and (e) one edge of each slot acts as a bearing surface on which the associated tab can pivot when the door is swung from its closed position to its fully-open position, such swinging of the door carrying said first arms into the slots associated with their respective tabs.

2. The device of claim 1 in which said door when fully open can be pushed inwardly of said support structure thereby pushing said first arm of each tab through its associated slot in a direction inwardly of said support structure, said support structure including latching portions immediately adjacent said first arms when the first arms are pushed through said slots that bear against said first arms when said door is urged toward said closed position, thereby holding said door in generally said fully-open position.

3. The combination of claim 1 in which:

(a) said device is a lighting fixture that includes a reflector, (b) said door when in its closed position blocks entry via said access opening to live components of said lighting fixture, and (c) said support structure is constituted by a portion of said reflector.

4. The combination of claim 3 in which: said reflector comprises a main body portion and a flange at the outer end of said main body portion, said support structure includes said flange, and said slots are located in the region of said reflector where said flange joins the main body portion of the reflector.

5. The combination of claim 2 in which:

(a) said device is a lighting fixture that includes a reflector, (b) said door when in its closed position blocks entry via said access opening to live components of said lighting fixture, and (c) said support structure is constituted by a portion of said reflector.

6. The combination of claim 5 in which: said reflector comprises a main body portion and a flange at the outer end of said main body portion, said support structure includes said flange, and said slots are located in the region of said reflector where said flange joins the main body portion of the reflector.

* * * * *